US007823969B2

(12) United States Patent
Kelleher

(10) Patent No.: US 7,823,969 B2
(45) Date of Patent: Nov. 2, 2010

(54) SEAT CADDY HAVING A SINGLE ADJUSTMENT POINT

(75) Inventor: Kevin Kelleher, Kirkland, WA (US)

(73) Assignee: KB Creations, Kirkland, WA (US)

( * ) Notice: Subject to any disclaimer, the term of this patent is extended or adjusted under 35 U.S.C. 154(b) by 710 days.

(21) Appl. No.: 11/471,890

(22) Filed: Jun. 20, 2006

(65) Prior Publication Data

US 2007/0007802 A1 Jan. 11, 2007

Related U.S. Application Data

(60) Provisional application No. 60/697,742, filed on Jul. 6, 2005.

(51) Int. Cl.
*A41C 1/16* (2006.01)

(52) U.S. Cl. ..... 297/188.12; 297/188.13; 297/219.1

(58) Field of Classification Search ..... 297/188.08, 297/188.12, 188.13; 224/153, 155, 275
See application file for complete search history.

(56) References Cited

U.S. PATENT DOCUMENTS 402,130 A * 4/1889 Bedford ..... 297/273
1,501,005 A * 7/1924 Larsen ..... 297/250.1
4,799,731 A * 1/1989 Brown ..... 297/188.12
5,370,060 A * 12/1994 Wang ..... 297/163
5,573,288 A * 11/1996 Raffensperger ..... 297/188.12
5,816,463 A * 10/1998 Echeverri ..... 224/153
5,927,800 A * 7/1999 Stallworth ..... 297/188.08
6,079,599 A * 6/2000 Nordstrom et al. ..... 224/153
6,082,816 A * 7/2000 Gottlieb et al. ..... 297/188.1
7,077,466 B2 * 7/2006 Forstner et al. ..... 297/188.08
2006/0006705 A1 * 1/2006 Charbonneau ..... 297/188.08

* cited by examiner

*Primary Examiner*—Peter R. Brown
(74) *Attorney, Agent, or Firm*—Kevin D. Jablonski; Graybeal Jackson LLP

(57) ABSTRACT

An embodiment of the invention is directed to a seat caddy having a single manipulation point for manipulating the fitting of the seat caddy to a suitable seat, such as a stadium seat or a lawn chair. Having a single adjustment point allows a user to more easily adjust and manipulate the seat caddy when engaging or disengaging a stadium seat and the like. Such a seat caddy allows for a simple cinching or uncinching of an adjustable cord when setting or removing the seat caddy when being used.

20 Claims, 4 Drawing Sheets

SEAT CADDY HAVING A SINGLE ADJUSTMENT POINT

REFERENCE TO RELATED APPLICATION

This application claims priority from U.S. Provisional Application 60/697,742 titled, "SEAT CUSHION HAVING A SINGLE ADJUSTMENT POINT," which was filed on Jul. 6, 2005, and which is incorporated by reference.

BACKGROUND OF THE INVENTION

Many people enjoy going to sporting events and concerts in stadium and event centers that have stadium seating, bench seating, bleacher seating, and the like. These types of seats in these stadiums and event centers offer much versatility for the facility with regard to cleaning and maintenance. However, with this versatility other seat amenities, such as seat cushioning and storage are sacrificed. As a result, many attachable seat cushions are available to the consumer to provide additional seat comfort and functionality in a removable and portable seat apparatus.

FIG. 1 shows an isometric view of a conventional seat cushion 100 having several different adjustment points 101-104 for attaching the seat cushion to a seat or chair. The conventional seat cushion 100 is typically designed to fit over a seat, e.g., a stadium seat and the like, such that each adjustment point may be adjusted individually to fit more securely with the contour of whatever seat the seat cushion 100 is attached to. Thus, as a person slips the conventional seat cushion 100 over a stadium seat for example, the individual must then adjust each of the four latch and strap combinations 101-104 in order to get the seat adjusted to fit more securely on the stadium seat.

Several problems are typically encountered when using the conventional seat cushion 100 of FIG. 1. First, when initially setting the seat cushion 100 to a typical stadium seat or lawn chair, each of the four adjustment points 101-104 must typically be adjusted separately as the latch and strap system depicted is not easily manipulated with a single hand. Even if an individual with extraordinary dexterity were able to manipulate one latch and strap system 101 with one hand, this still leaves only one other hand free for one of the other three latch and strap adjustment points 102-104.

Furthermore, once the conventional seat cushion 100 is in place, adjusting the fit of the seat cushion 100 to the stadium seat also typically requires adjusting each of the four adjustment points 101-104. Similarly, when removing the seat cushion 100 from the stadium seat, once again, each of the four adjustment points 101-104 must typically be adjusted or released in order to more easily remove the conventional seat cushion 100 from the engaged stadium seat.

Another problem with the conventional seat cushion 100 of FIG. 1 is that having four adjustment points 101-104 prevents use with a standard bleacher or bench seating. This conventional seat cushion 100 shows the four adjustment points 101-104 as being detachable (i.e., clasps) which be disengaged and re-engaged around a bleacher seat. However, some conventional seat cushions (not shown) do not have detachable adjustment points 101-104. Furthermore, the same multi-faceted adjustment process must still take place when engaging a bleacher.

As such, having several adjustment points results in a more time-consuming and burdensome manipulation when engaging or disengaging the conventional seat cushion 100 of FIG. 1.

SUMMARY OF THE INVENTION

An embodiment of the invention is directed to a seat caddy having a single manipulation point for manipulating the fitting of the seat caddy to a suitable seat, such as a stadium seat or a lawn chair. Having a single adjustment point allows a user to more easily adjust and manipulate the seat caddy when engaging or disengaging a stadium seat and the like. Such a seat caddy allows for a simple cinching or uncinching of an adjustable cord when setting or removing the seat caddy when being used.

According to one embodiment of the invention, an adjustment cord is attached to a top and bottom portion of a seat caddy such that an adjustment point may be adjusted to cinch the cord tighter. In this manner the bottom portion and top portion of the seat caddy are drawn closer together and may engage a stadium seat or lawn chair.

In an alternative embodiment, the adjustable cord is attached to the top and bottom portion along with a removably attached latch at the rear. Such a seat caddy may be removable attached to a bleacher or bench seat while also providing a single adjustment point for cinching the seat caddy tightly to the bench or bleacher.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The following discussion is presented to enable a person skilled in the art to make and use the invention. The general principles described herein may be applied to embodiments and applications other than those detailed above without departing from the spirit and scope of the present invention. The present invention is not intended to be limited to the embodiments shown, but is to be accorded the widest scope consistent with the principles and features disclosed or suggested herein.

Figure 1:
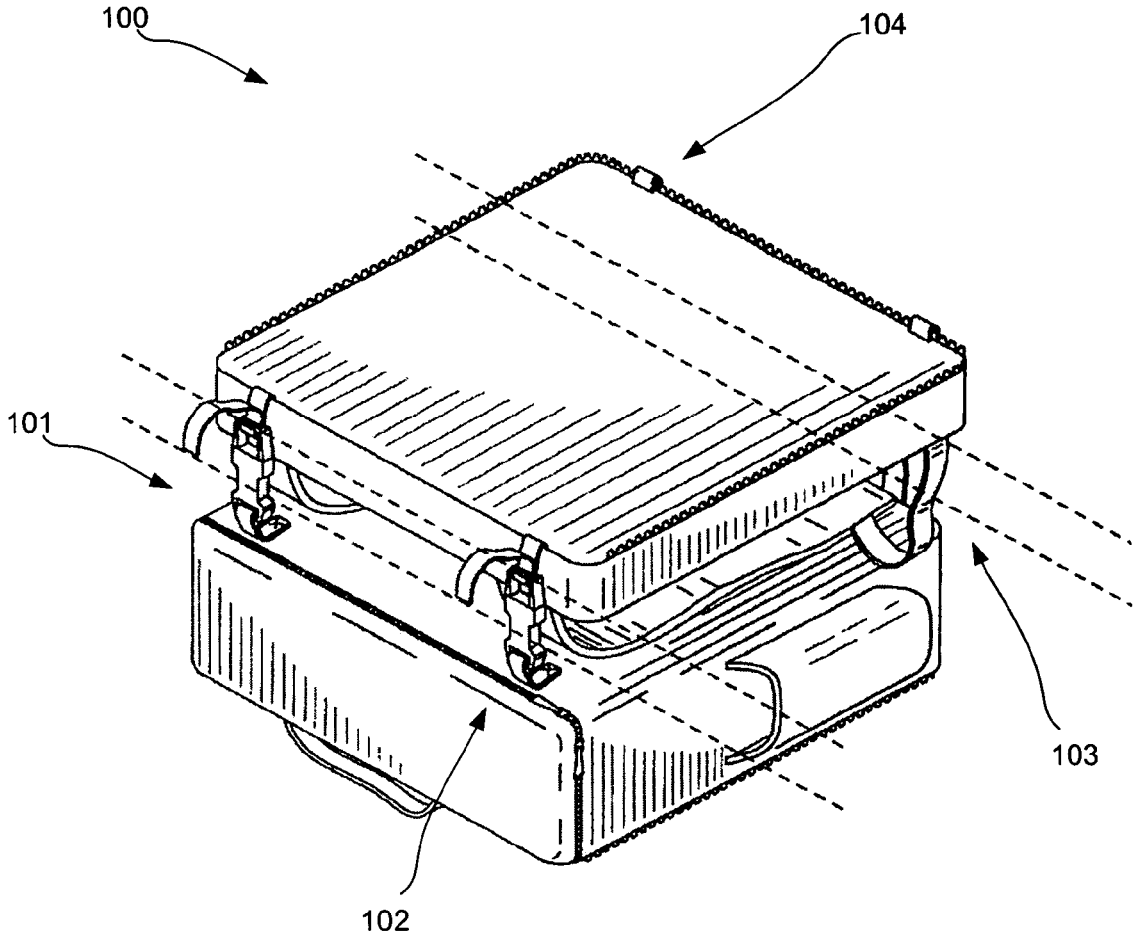
FIG. 1 (PRIOR ART)
FIG. 1 is an isometric view of a conventional seat cushion having a conventional latch and strap system with several adjustment points.
Figure 2:
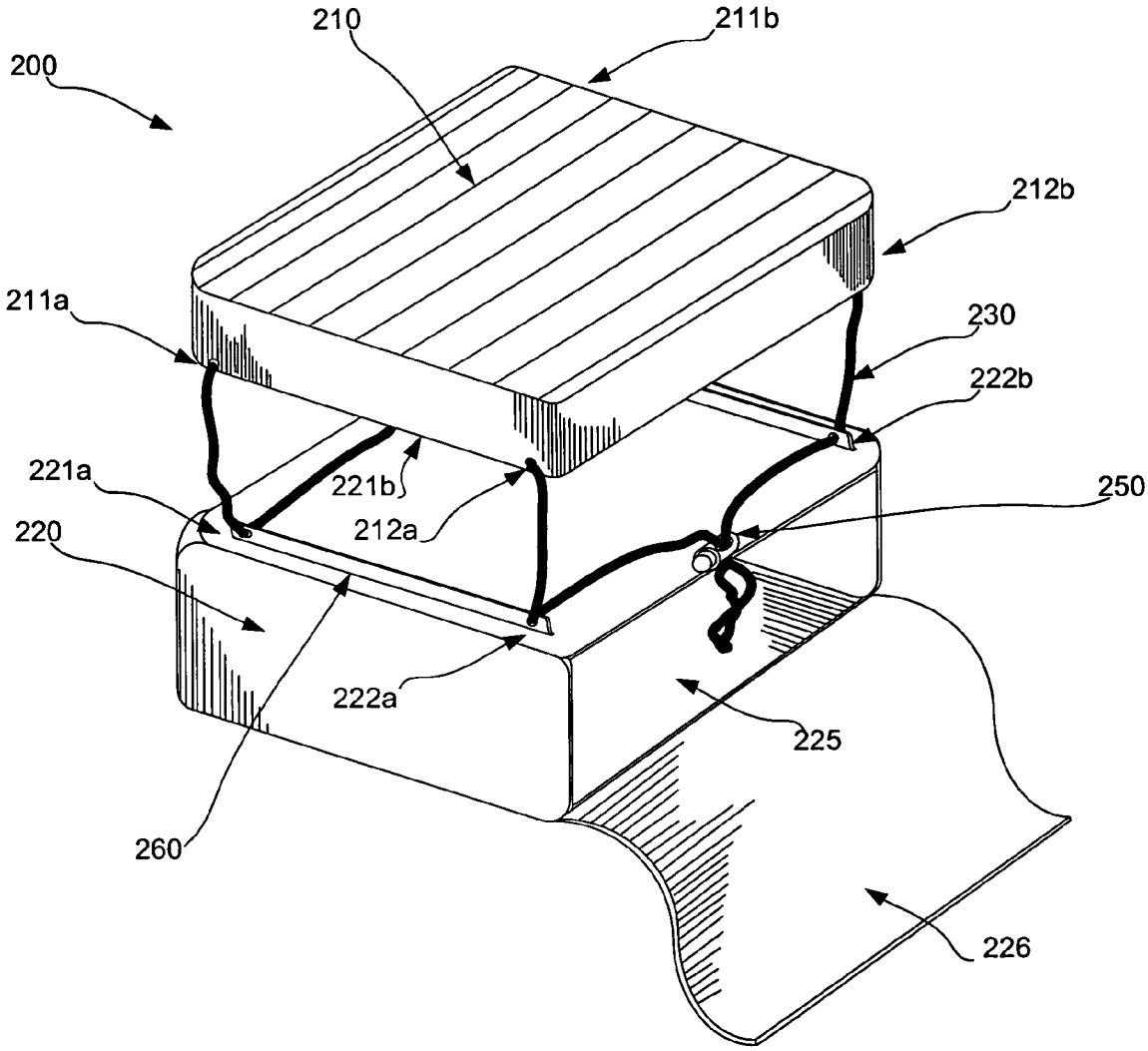
FIG. 2 is an isometric view of a seat caddy having a single draw cord latching system with a single manipulation point according to an embodiment of the invention.

FIG. 2 is an isometric view of a seat caddy 200 having a single adjustable draw cord 230 with a single manipulation point 250 according to an embodiment of the invention. The seat caddy 200 includes a top portion 210 and a bottom portion 220 that are attached to each other via an adjustable cord 230. The adjustable cord 230 is typically attached to the top portion 210 via two pairs of eyeholes 211*a/b* and 212*a/b*. The first pair of eyeholes 211*a/b* (only one can be seen in this isometric view of FIG. 2) is typically located toward the rear of the top portion 210 while the second pair of eyeholes

212*a/b* (again, only one can be seen in the isometric view of FIG. 2) is typically located toward the front of the top portion 210.

Further, the adjustable cord 230 is also typically attached to the bottom portion 220 via two pairs of eyeholes 221*a/b* and 222*a/b* on the top side of the bottom portion 220. The first pair of eyeholes 221*a/b* (only one can be seen in this isometric view of FIG. 2) is again typically located toward the rear of the bottom portion 220 while the second pair of eyeholes 222*a/b* (both can be seen in the isometric view of FIG. 2) is typically located toward the front of the bottom portion 220.

The adjustable cord 230 traverses the lateral length of both the top and bottom portions 210 and 220 of the seat caddy 200 along the front and back sides as shown in FIG. 2. Further, the adjustable cord 230 meets at an adjustment point 250 at the front side of the bottom portion 220 such that the adjustable cord 230 may be cinched up tighter or let loose to be longer in an effort to adjust the seat caddy 200.

Thus, if one were to follow the length of the adjustable cord 230 starting at the adjustment point 250, the adjustable cord 230 would traverse to the left along the front of the bottom portion 220 toward a first eyehole 222*a*. It would then traverse upward to the top portion to the eyehole 212*a*. Then, the adjustable cord 230 traverses toward the back of the seat caddy 200 along the left side of the top portion 210 toward the eyehole 211*a*. This span of the adjustable cord 250 cannot be seen in FIG. 2 as the cord is typically inside the top portion 210 of the seat caddy 200. When the adjustable cord 230 remerges from the top portion 210 at the eyehole 211*a*, it traverses back down to the bottom portion 220 to the eyehole 221*a* before traversing across the lateral length of the bottom portion 220 along the back to another eyehole 221*b* (which cannot be seen in the isometric view).

Similarly, on the right side now, the adjustable cord 230 traverses back up to the top portion 210 to another eyehole 211*b* (which cannot be seen in FIG. 2) where is traverses toward the front of the top portion 210 along the right side to the eyehole 212*b* (wherein neither this span of the cord 230 nor the eyehole 212*b* can be seen because of the isometric view). The adjustable cord 230 then traverses back down again to the bottom portion 220 to the eyehole 222*b* before traversing toward the adjustment point 250 again along the front of the bottom portion 220.

With a single adjustable cord 230 woven throughout the top and bottom portions 210 and 220 of the seat caddy 200 as described above, any adjustment to the cord 230 will result in the lengthening or shortening of the distance between the two portions 210 and 220 because this distance is not fixed by any physical length between any eyeholes. That is, only the spans between the top and bottom portions 210 and 220 (i.e., the span between eyeholes 222*a*-212*a*, 221*a*-211*a*, 221*b*-211*b*, and 222*b*-212*b*) are able to be adjusted because of the free space between the top portion 210 and the bottom portion 220.

The adjustment point 250 may be a conventional push-button latch as shown. Alternatively, the adjustment point 250 may not include any type of latching or tying mechanism as the adjustable cord 230 may simply be anchored by tying a knot at the adjustment point. Further, the adjustment point may be other implementable mechanisms for allowing adjustment such as a hook and latch attachment (i.e., Velcro™), a tie-down, a pressure-ring latch, a snap, or a zip-latch. Other latching or securing mechanisms are contemplated but not described herein for brevity.

The top portion 210 and bottom portion 220 of the seat caddy 200 are typically made of a leather material, but alternatively may be a canvas, vinyl, plastic, composite, fabric, or any other suitable cushion material operable to withstand specific stresses cause by use and adjustment. Other materials and/or components are contemplated but not described herein for brevity.

The bottom portion 220 may include (or comprise in and of itself) a cavity 225 for a storage space. The storage space may typically be large enough to store beverages and food and may typically include an insulation material for maintaining temperatures inside the cavity 225 different from the ambient temperature outside the cavity 225. For example, placing cold items in the insulated storage space will allow for the cold items to have a tendency to remain cold. The seat caddy 200 may also include a cover 226 for the cavity 225 that may be manually opened, closed, and latched (via a typical latching mechanism not shown in FIG. 2.) as desired by a user of the seat caddy 200.

The top portion 210 and the bottom portion 220 may further include cord tracks (not shown) suitable foe more easily facilitating the sliding of the adjustable cord 230 between the eyeholes inside the top the top portion 210. Further, either the top or bottom portions 210 or 220 may also (or alternatively) includes cord guides 260 for guiding the adjustable cord 230 as it is woven throughout the seat caddy 200.

The embodiment of FIG. 2 may be well suited for engaging a stadium seat such as those typically having a biased, rotatable seat portion that may be rotated down for sitting and rotated up for cleaning the space below the seat. Further, the seat caddy 200 may also be well suited for engaging a lawn chair having a collapsible seat portion. Other embodiments, such as the one described below with respect to FIG. 3 may be well-suited for engaging a bleacher or bench seat.

Figure 3:
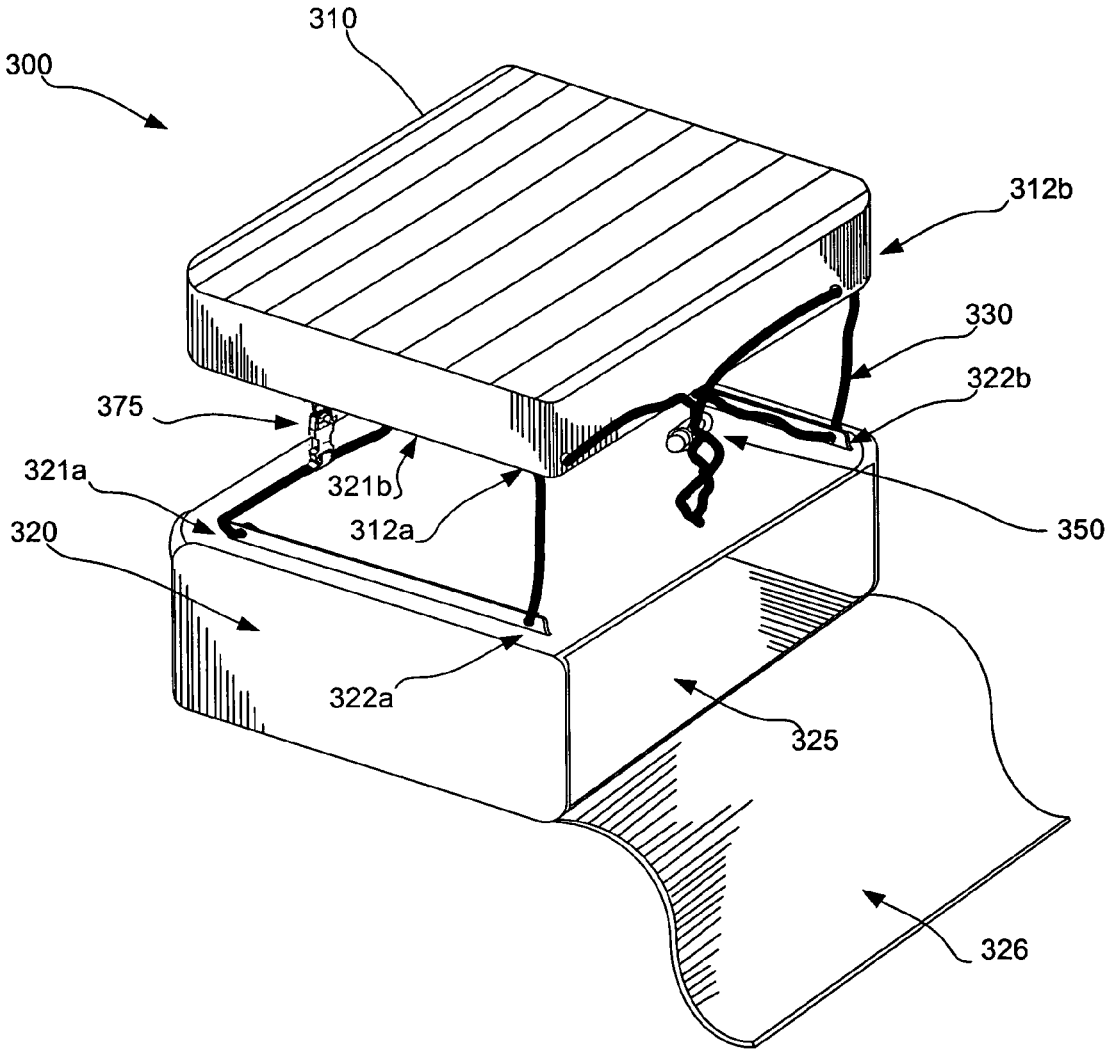
FIG. 3 is an isometric view of a seat caddy having a single draw cord latching system with a rear attachment point and a single manipulation point according to an embodiment of the invention.

FIG. 3 is an isometric view of a seat caddy 300 having a single draw cord 230 with a rear attachment point 375 and a single manipulation point 350 according to an embodiment of the invention. Similar to the seat caddy 200 described above, the seat caddy 300 includes a top portion 310 and a bottom portion 320 that are attached to each other via an adjustable cord 330 as well as a rear attachment 375. In this embodiment, the adjustable cord 330 is typically attached to the top portion via a single pair of eyeholes 312*a/b*. The pair of eyeholes 312*a/b* (only one can be seen in this isometric view of FIG. 3) is typically located toward the front of the top portion 310. However, there is no similar pair of eyeholes in the rear and this is different than the embodiment of FIG. 2.

Further, the adjustable cord 330 is also typically attached to the bottom portion 320 via two pairs of eyeholes 321*a/b* and 322*a/b* that are part of an attachment flap on the top side of the bottom portion 320. The first pair of eyeholes 321*a/b* (only one can be seen in this isometric view of FIG. 3) is typically located toward the rear of the bottom portion 320 while the second pair of eyeholes 322*a/b* (both can be seen in the isometric view of FIG. 3) is typically located toward the front of the bottom portion 320.

The adjustable cord 330 traverses the lateral length of the top and bottom portions 310 and 320 of the seat caddy 300 respectively along the front and back sides as shown in FIG. 3. Differently from the seat caddy 200 of FIG. 2, the adjustable cord 330 does not traverse from the top portion 310 to the bottom portion 320 in the rear. Instead, the adjustable cord 330 remains along the lateral length of the bottom portion 320 and traverses laterally across the bottom portion 320 from eyehole 321*a* to the eyehole 321*b* on the opposite side (which cannot be seen in this isometric view). In this traversal, the adjustable cord 330 passes though an eyelet attached to the rear attachment 375 such that the cord 330 may freely slide though. As before, the adjustable cord 330 also meets at an adjustment point 350 at the front side but at the top portion 310 (in this embodiment) such that the adjustable cord 330 may be cinched up tighter or let loose to be longer in an effort to adjust the seat caddy 300. In this embodiment, when cinched, the rear attachment 375 draws the top and bottom portions 310 and 320 together because the rear attachment 375 is attached to both the top and bottom portions 310 and 320 as the adjustable cord 330 slides through the eyelet and tightens any slack.

Thus, if one were to follow the length of the adjustable cord 330 starting at the adjustment point 350, the adjustable cord 330 would traverse to the left along the front of the top portion 310 toward a first eyehole 312*a*. It would then traverse downward to the bottom portion 320 to the eyehole 322*a*. Then the adjustable cord 330 traverses toward the back of the seat caddy 300 along the left side of the bottom portion 320 toward the eyehole 321*a*. This span of the adjustable cord 350 may or may not be hidden as the cord 330 is typically inside the bottom portion 320 of the seat caddy 300. When the adjustable cord 330 remerges from the bottom portion 320 at the eyehole 321*a*, it traverses laterally across the bottom portion 320 to the eyehole 321*b* before traversing across the right side of the bottom portion 320 along the right to another eyehole 322*b*. Similarly on the right side now, the adjustable cord 330 traverses back up to the top portion 310 to another eyehole 312*b*. The adjustable cord 330 then traverses back toward the adjustment point 350 again along the front of the top portion 310.

Again, with a single adjustable cord 330 woven throughout the top and bottom portions 310 and 320 of the seat caddy 300 as described above, any adjustment to the cord 330 will result in the lengthening or shortening of the distance between the two portions 310 and 320 because this distance is not fixed by any physical length between any eyeholes. That is, only the spans between the top and bottom portions 310 and 320 (i.e., the span between eyeholes 322*a*-312*a*, and 322*b*-312*b*) are able to be adjusted because of the free space between the top portion 310 and the bottom portion 320.

As before, the adjustment point 350 may be a conventional push-button latch. The top portion and bottom portion 320 of the seat caddy 300 is typically a made of a leather material and the bottom portion 320 includes a cavity 325 for a storage space that may include a cover 326. Furthermore, the rear attachment 375 may also be any of the aforementioned latching systems suitable for securing the rear sections of the top and bottom portions 310 and 320 together.

Figure 4:
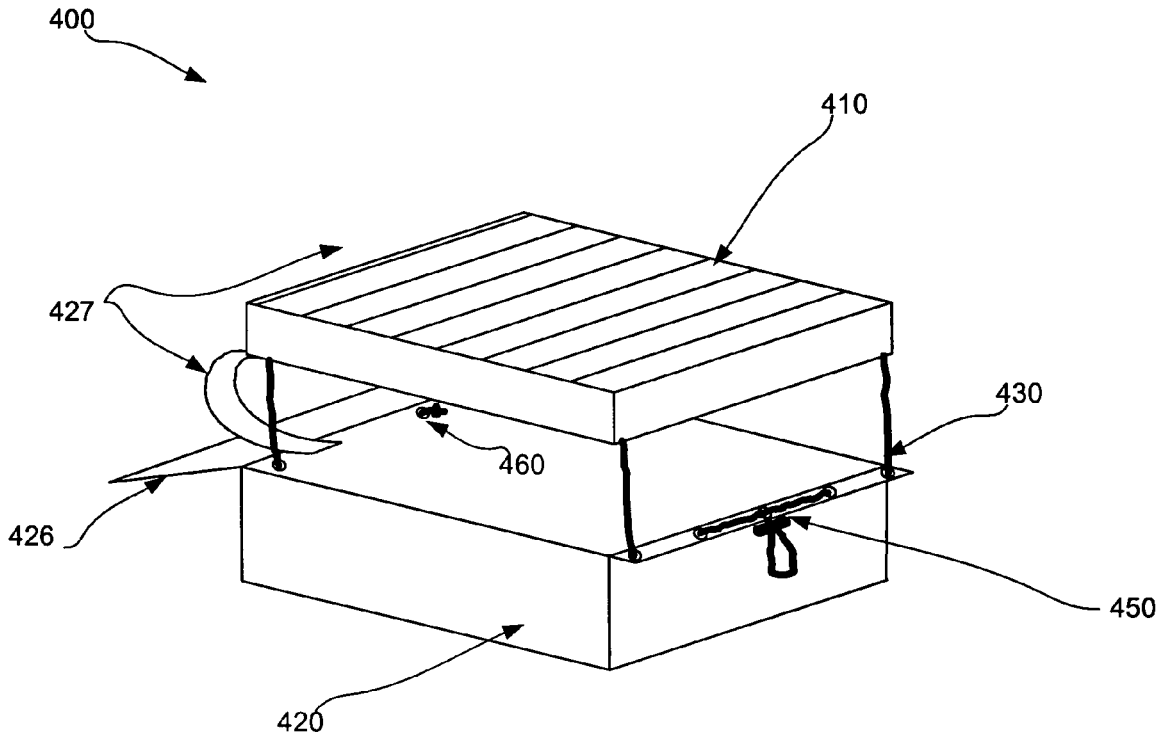
FIG. 4 is an isometric view of a seat caddy having a single draw cord latching system a single manipulation point in the rear according to an embodiment of the invention.

FIG. 4 is an isometric view of a seat caddy 400 having a single adjustable draw cord 430 with a single manipulation point 450 in the rear according to another embodiment of the invention. The seat caddy 400 includes a top portion 410 and a bottom portion 420 that are attached to each other via an adjustable cord 430. The adjustable cord 430 is typically attached to the top portion 410 and bottom portion 420 in manner described previously.

In this embodiment, the adjustable cord 430 traverses the lateral length of the bottom portions 420 of the seat caddy 400 along the front and back sides as shown in FIG. 4. Further, the adjustable cord 430 meets at an adjustment point 450 at the back side of the bottom portion 420 such that the adjustable cord 430 may be cinched up tighter or let loose to be longer in an effort to adjust the seat caddy 400.

With a single adjustable cord 430 woven throughout the top and bottom portions 410 and 420 of the seat caddy 400 as described above, any adjustment to the cord 430 will result in the lengthening or shortening of the distance between the two portions 410 and 420 because this distance is not fixed by any physical length between any eyeholes. That is, only the spans between the top and bottom portions 410 and 420 are able to be adjusted because of the free space between the top portion 410 and the bottom portion 420.

The adjustment point 450 may be a conventional push-button latch as shown. Alternatively, the adjustment point 450 may not include any type of latching or tying mechanism as the adjustable cord 430 may simply be anchored by tying a knot at the adjustment point 450.

The bottom portion 420 may include (or comprise in and of itself) a cavity for a storage space. The storage space may typically be large enough to store beverages and food and may typically include an insulation material for maintaining temperatures inside the cavity. The seat caddy 400 may also include a cover 426 for the cavity that may be manually opened, closed, and latched (via a typical latching mechanism not shown in FIG. 4.) as desired by a user of the seat caddy 400.

The top portion 410 and the bottom portion 420 may further include front locating straps 426 for engaging a pivoting stadium seat (not shown). The front locating straps 426 allow the seat caddy 400 to rest on the front of the stadium seat in while it's in the up position. The front locating straps 426 prevent the seat caddy 400 from sliding forward or backward and help locate the top portion 410 and bottom portion 420 properly prior to cinching them together. The straps 426 may snap on and off which allows quick release and interchangeability between all top portion 410 and bottom portion 420 options. Further, the adjustment cord 430 may be completely unlaced when interchanging, such that the adjustment cord 430 is removed from the woven pattern through the top and bottom portion 410 and 420 and only remains attached at permanent origin points 460.

The various designs described in FIGS. 2-4 above provide for at least two options for seat caddies. One such option is a thin and compact cushion with a geometry and shape roughly the same size as the bag as shown the FIGs. Such a design does not provide as much comfort, but it is more compact and provides a support for suspending the storage cavity.

According to a second option for the seat caddy, a thicker and more robust cushion covers a larger seating area. Such a design is not as compact, but provides more comfort as well as a support for suspending the storage cavity. The storage cavity may be manufactured in a number of different sizes including 3", 4" and 5" widths, depending on one's storage requirements.

While the invention is susceptible to various modifications and alternative constructions, certain illustrated embodiments thereof are shown in the drawings and have been described above in detail. It should be understood, however, that there is no intention to limit the invention to the specific forms disclosed, but on the contrary, the intention is to cover all modifications, alternative constructions, and equivalents falling within the spirit and scope of the invention.

What is claimed is:

1. A seat caddy, comprising:

a discrete top portion operable to engage a seat;

a discrete bottom portion; and a manipulation mechanism adjustably coupling the top portion and the bottom portion, the manipulation mechanism operable to manipulate an adjustable space between the top portion and the bottom portion at a single manipulation point;

wherein the to portion is approximately rectangular haying four top-portion corners and the bottom portion is approximately rectangular having four bottom-portion corners corresponding to the four top-portion corners; and wherein the manipulation mechanism is a contiguous elongated member spanning between and proximate to each of the corresponding top-portion corners and bottom-portion corners.

2. The seat caddy of claim 1 wherein the manipulation mechanism further comprises an adjustable cord adjustably coupling the top portion and the bottom portion such that cinching the cord adjusts the space between the top portion and bottom portion.

3. The seat caddy of claim 2 wherein the manipulation mechanism further comprises a latching device for securing the adjustable cord, the latching device selected from the group comprising: a push-button latch, a hook and latch attachment, a tie-down, a pressure-ring latch, a snap, and a zip-latch.

4. The seat caddy of claim 2 wherein the adjustable cord comprises a cord made from one of the group comprising: nylon rope, leather, cloth rope, plastic, and rubber.

5. The seat caddy of claim 2 wherein the adjustable cord is housed in a cord track such that the cord is enclosed in the cord track along the lateral sides of the top portion and enclosed along the front and back sides of the bottom portion.

6. The seat caddy of claim 2 wherein portions of the adjustable cord are disposed within portions of the top portion and within cord eyeholes.

7. The seat caddy of claim 1 wherein the bottom portion comprises a storage cavity having a movable flap opening such that the movable flap opening may be secured in a closed position enclosing the storage cavity and secured in an open position exposing the storage cavity.

8. The seat caddy of claim 7 wherein the storage cavity is insulated for maintaining a temperature inside the storage cavity.

9. The seat caddy of claim 1, wherein the top portion and bottom portion comprises a material selected from the group comprising: leather, vinyl, cloth, plastic, composite, fabric, and canvas.

10. The seat caddy of claim 1 wherein the top portion further comprises a cushion surface suitable for seating a human.

11. The seat caddy of claim 1, wherein the manipulation mechanism is a contiguous elongated member and spans between the top portion and bottom portion at least twice.

12. The seat caddy of claim 1, further comprising an attachment strap member spanning between and coupling the top portion and the bottom.

13. The seat caddy of claim 1 wherein portions of the contiguous elongated member are disposed within portions of the top portion and within portions of the bottom portion.

14. A seat caddy, comprising:

a top portion operable to engage a seat;

a bottom portion adjustably attached to the top portion; and a manipulation mechanism operable to adjustably attach the top portion to the bottom portion, the manipulation mechanism operable to manipulate an adjustable space between the top portion and the bottom portion at a single adjustment; point wherein the manipulation mechanism further comprises an adjustable cord which is attached to the adjustment point at the front of the bottom portion and traverses the seat caddy in a manner comprising:

from the adjustment point to the front left corner of the bottom portion;

from the front left corner of the bottom portion to the front left corner of the top portion;

from the front left corner of the top portion to the back left corner of the top portion;

from the back left corner of the bottom portion to the back left corner of the bottom portion;

from the back left corner of the bottom portion to the back right corner of the bottom portion;

from the back right corner of the bottom portion to the back right corner of the top portion;

from the back right corner of the top portion to the front right corner of the top portion;

from the front right corner of the top portion to the front right corner of the bottom portion; and from the front right corner of the bottom portion to the adjustment point.

15. The seat caddy of claim 14 wherein the traversal of the adjustable cord within the seat caddy is well-suited for allowing the seat caddy to engage a stadium seat.

16. An apparatus, comprising:

a seat suitable for supporting a human in a sitting position; and a seat caddy engaged with the seat, the seat caddy comprising:

a discrete top portion operable to rest upon the seat and support a human;

a discrete bottom portion suspended from the to portion by an adjustable cord that is the only coupling between the top portion and the bottom portion; and a manipulation mechanism operable to adjustably manipulate the cord coupling the top portion and the bottom portion, the manipulation mechanism operable to manipulate an adjustable space between the top portion and the bottom portion at a single manipulation point.

17. The apparatus of claim 16 wherein the seat comprises a stadium seat having a biased, rotatable seat portion suitable for engaging the seat caddy.

18. The apparatus of claim 16 wherein the seat comprises a lawn chair having a collapsible seat portion suitable for engaging the seat caddy.

19. The apparatus of claim 16 wherein the space between the top portion and the bottom portion of the seat caddy may be adjusted via the adjustment mechanism to securely engage the seat.

20. A method for attaching a seat caddy to a seat, the method comprising:

engaging an adjustable seat caddy with a seat, such that a discrete top portion rests on the seat and a discrete bottom portion is coupled to the top portion via an adjustable cord and suspended from the top portion by the adjustable cord and no other structure; and adjusting the adjustable cord at a single adjustment point such that the top portion and the bottom portion are cinched together to securely engage the seat wherein the top portion rests upon a top of the seat and the bottom portion is held securely to a bottom of the seat by the adjustable cord.

* * * * *

UNITED STATES PATENT AND TRADEMARK OFFICE

CERTIFICATE OF CORRECTION

PATENT NO. : 7,823,969 B2
APPLICATION NO. : 11/471890
DATED : November 2, 2010
INVENTOR(S) : Kevin Kelleher It is certified that error appears in the above-identified patent and that said Letters Patent is hereby corrected as shown below:

- Column 7, Line 58 of the patent, should read "single adjustment point;"
- Column 8, Line 29 of the patent, should read "a discrete bottom portion suspended from the top portion".

Signed and Sealed this
Fifth Day of April, 2011

David J. Kappos

David J. Kappos
*Director of the United States Patent and Trademark Office*